US009958121B2

(12) United States Patent
Wu

(10) Patent No.: US 9,958,121 B2
(45) Date of Patent: May 1, 2018

(54) SWIVEL-TYPE NIGHT LIGHT

(71) Applicant: Dongguan Yali Electric co., Ltd., Dongguan (CN)

(72) Inventor: Hai-Feng Wu, Dongguan (CN)

(73) Assignee: Dongguan Yali Electric Co., Ltd., Dongguan (CN)

( * ) Notice: Subject to any disclaimer, the term of this patent is extended or adjusted under 35 U.S.C. 154(b) by 90 days.

(21) Appl. No.: 14/969,040

(22) Filed: Dec. 15, 2015

(65) Prior Publication Data

US 2017/0167673 A1 Jun. 15, 2017

(51) Int. Cl.

| | |
|---|---|
| ***H01R 33/00*** | (2006.01) |
| ***F21S 8/00*** | (2006.01) |
| ***F21V 23/04*** | (2006.01) |
| ***H01R 39/64*** | (2006.01) |

(52) U.S. Cl.
CPC ..... *F21S 8/035* (2013.01); *F21V 23/04* (2013.01); *H01R 39/64* (2013.01)

(58) Field of Classification Search
CPC ..... F21S 8/035; F21V 23/04; H01R 39/64
USPC ..... 362/641–644
See application file for complete search history.

(56) References Cited

U.S. PATENT DOCUMENTS

| | | | | |
|---|---|---|---|---|
| 5,352,122 A * | 10/1994 | Speyer | F21S 8/035 439/13 |
| 6,843,656 B2 * | 1/2005 | Hwang | F21S 8/035 439/11 |
| 8,147,097 B1 * | 4/2012 | Hsiao | F21S 8/035 362/288 |
| 8,147,116 B1 * | 4/2012 | Hsiao | F21S 8/035 362/326 |
| 8,425,105 B2 * | 4/2013 | Yang | F21S 8/035 362/641 |

* cited by examiner

*Primary Examiner* — Jason Moon Han
(74) *Attorney, Agent, or Firm* — Alan D. Kamrath; Kamrath IP Lawfirm, P.A.

(57) ABSTRACT

A swivel-type night light includes a housing, a socket mechanism, a bulb mechanism, a switch, a fixed seat, an intermediate seat, a connecting seat, a bottom ring, a positive blade, a negative blade, a positive conducting plate, a negative conducting plate, and a conducting member. The positive blade has a first tongue contacting with the positive conducting plate. The negative blade has a second tongue contacting with the negative conducting plate. A bulb is mounted on the bulb mechanism and is electrically connected with the conducting member by an internal thread. The fixed seat is rotatable relative to the connecting seat through 360 degrees. A plastic ring is arranged between the positive conducting plate and the negative conducting plate to prevent the positive conducting plate and the negative conducting plate from contacting with each other.

5 Claims, 10 Drawing Sheets

SWIVEL-TYPE NIGHT LIGHT

BACKGROUND OF THE INVENTION

1. Field of the Invention

The present invention relates to a light and, more particularly, to a swivel-type night light.

2. Description of the Related Art

A conventional night light comprises a housing, a rotor, a stator, two concentric conducting rings, two transmission plates, and a base. The rotor is mounted in the housing and provided with two blades each extending outward from the housing to construct a plug that is inserted into a socket. Each of the blades of the rotor has an inner end contacting with each of the two conducting rings. The stator is mounted in the housing. The two conducting rings are mounted in an end face of the stator. Each of the two conducting rings is provided with a conducting strip extending through the stator and contacting with each of the two transmission plates. Each of the two transmission plates extends into the base. Thus, when the two blades of the rotor are rotated, the two transmission plates keep in contact with the two conducting rings. However, the two conducting rings easily contact with each other to cause an electric short circuit. In addition, the contact between the plug and the socket is poor during rotation.

BRIEF SUMMARY OF THE INVENTION

In accordance with the present invention, there is provided a swivel-type night light comprising a housing, a socket mechanism mounted on the housing, a bulb mechanism mounted on the housing, and a switch mounted on the housing. The housing includes a first casing and a second casing combined together. The first casing has a left side provided with a slideway. The second casing has a right side provided with a fixed seat. An intermediate seat is mounted on a right side of the fixed seat. A connecting seat is mounted around the fixed seat and the intermediate seat, and the fixed seat is rotatable relative to the connecting seat through 360 degrees. The connecting seat includes a first shell and a second shell combined together. A bottom ring is mounted on a right side of the intermediate seat. A thin plate is mounted on a right side of the bottom ring. The fixed seat has a left end face provided with a projection. A first spring is mounted on the projection of the fixed seat and is biased between the switch and the fixed seat. The intermediate seat has a right end face provided with two insertion slots for securing a positive blade and a negative blade. Each of the positive blade and the negative blade has a left end respectively provided with a first tongue and a second tongue protruding outward from a left end face of the intermediate seat. The first tongue of the positive blade contacts with a positive conducting plate so that the positive blade is electrically connected with the positive conducting plate. The second tongue of the negative blade contacts with a negative conducting plate so that the negative blade is electrically connected with the negative conducting plate. The negative conducting plate surrounds the positive conducting plate. The positive conducting plate is provided with a positive transmission strip extending through a first guide slot of the fixed seat. The negative conducting plate is provided with a negative transmission strip extending through a second guide slot of the fixed seat. The positive transmission strip is provided with a positive contact piece protruding outward from the first guide slot of the fixed seat. The negative transmission strip is provided with a negative contact piece protruding outward from the second guide slot of the fixed seat. The negative contact piece extends to a conducting member and is electrically connected with a negative electrode. The positive contact piece extends to the conducting member and is electrically connected with a positive electrode by regulation of the switch. A bulb is mounted on the bulb mechanism and is electrically connected with the conducting member by an internal thread. The switch is slidably mounted in the slideway of the housing.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
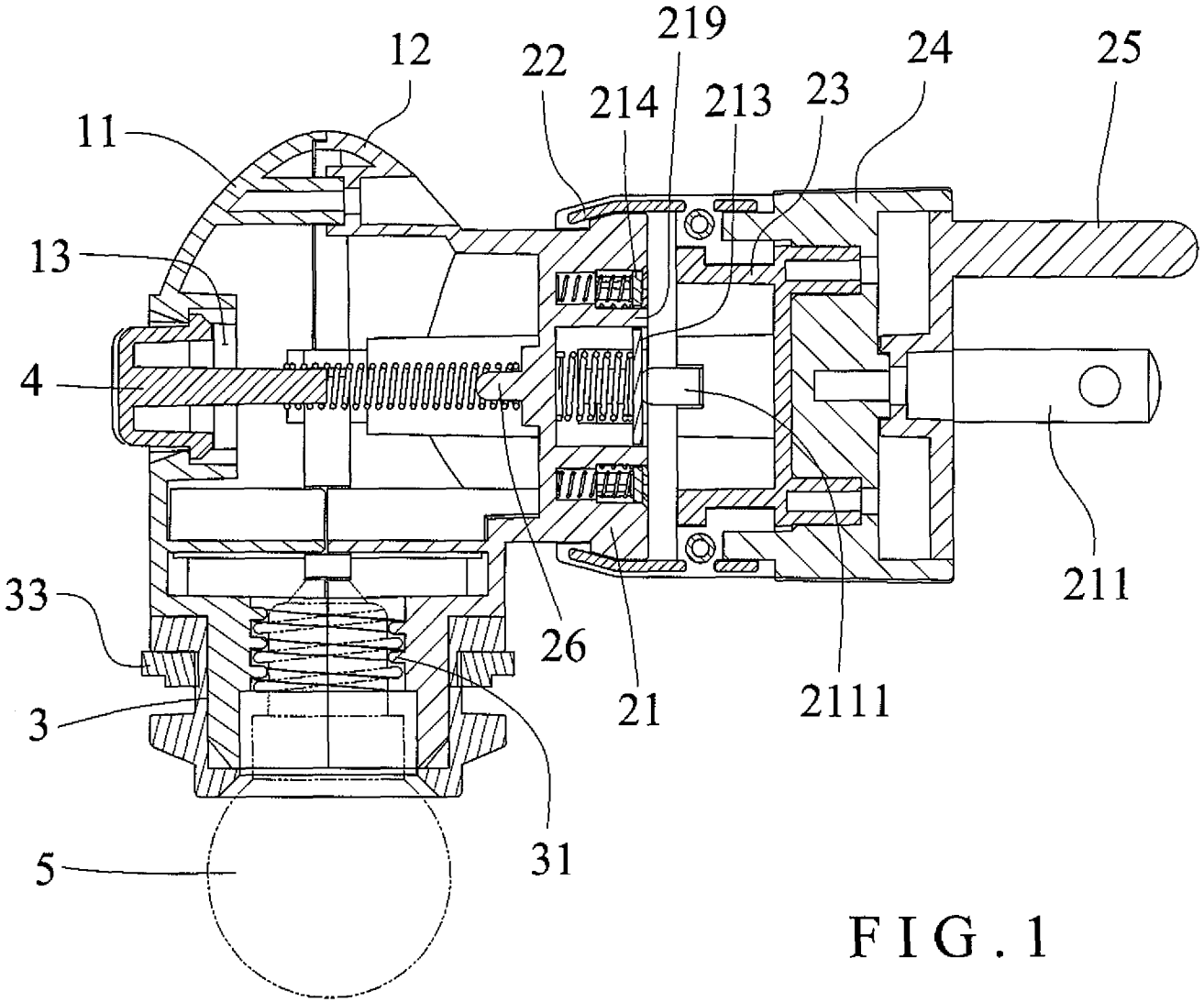
FIG. 1 is a cross-sectional view of a swivel-type night light in accordance with the preferred embodiment of the present invention.
Figure 2:
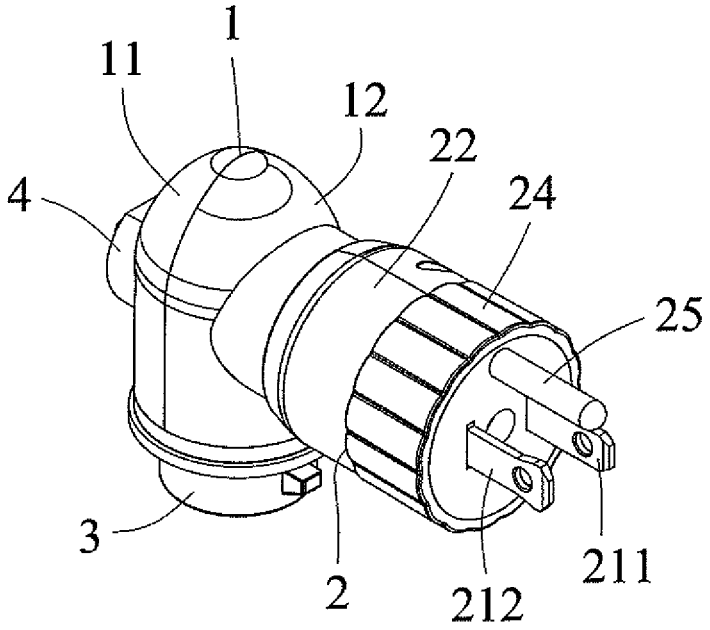
FIG. 2 is a perspective view of the swivel-type night light in accordance with the preferred embodiment of the present invention.
Figure 3:
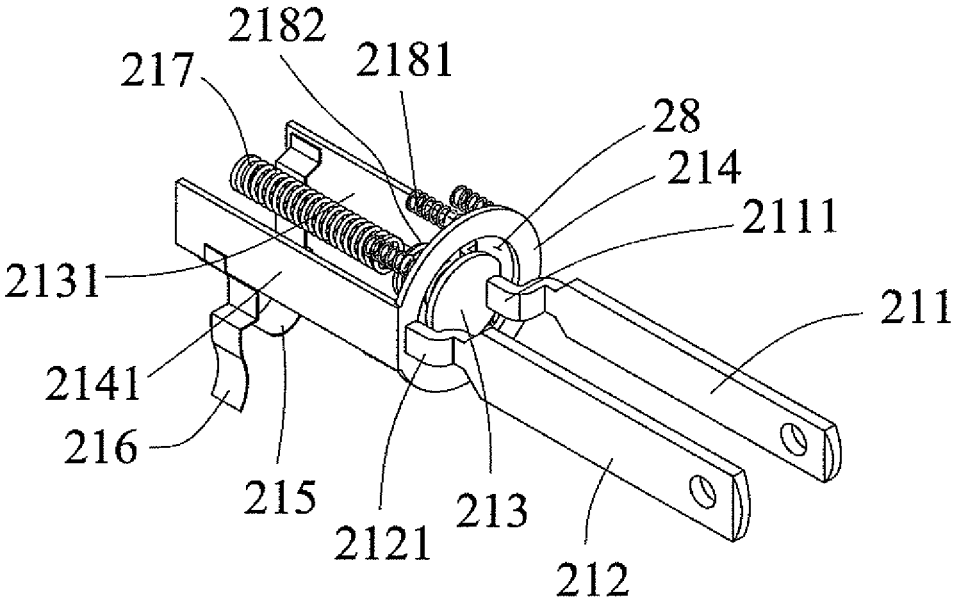
FIG. 3 is a partially perspective view of the swivel-type night light as shown in FIG. 2.
Figure 4:
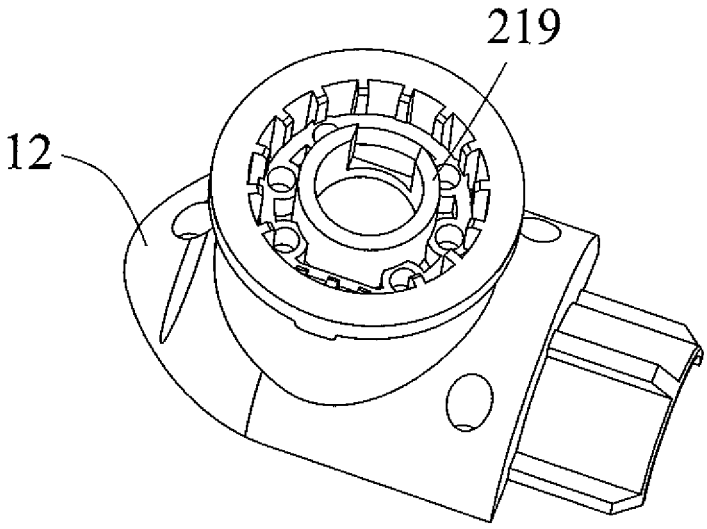
FIG. 4 is a bottom perspective view of a fixed seat of the swivel-type night light.
Figure 5:
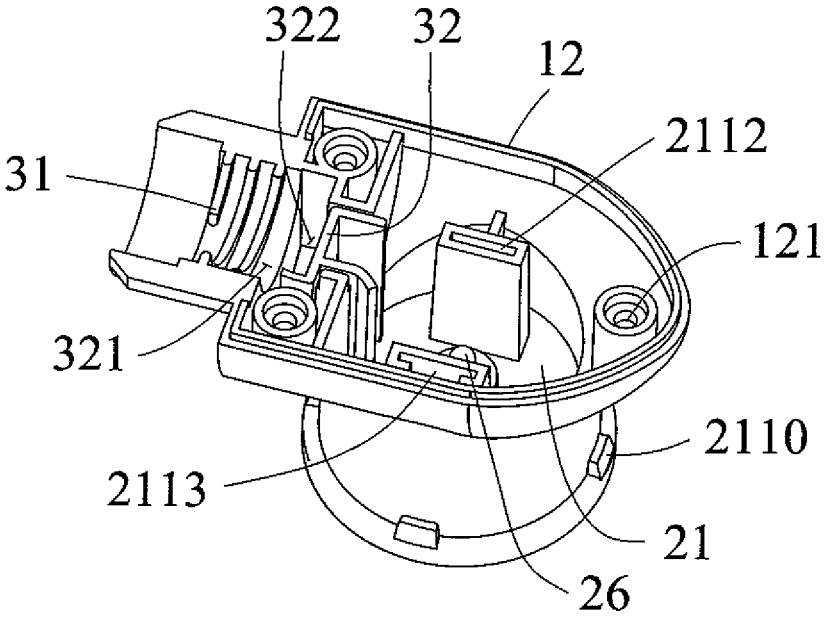
FIG. 5 is a top perspective view of the fixed seat of the swivel-type night light.
Figure 6:
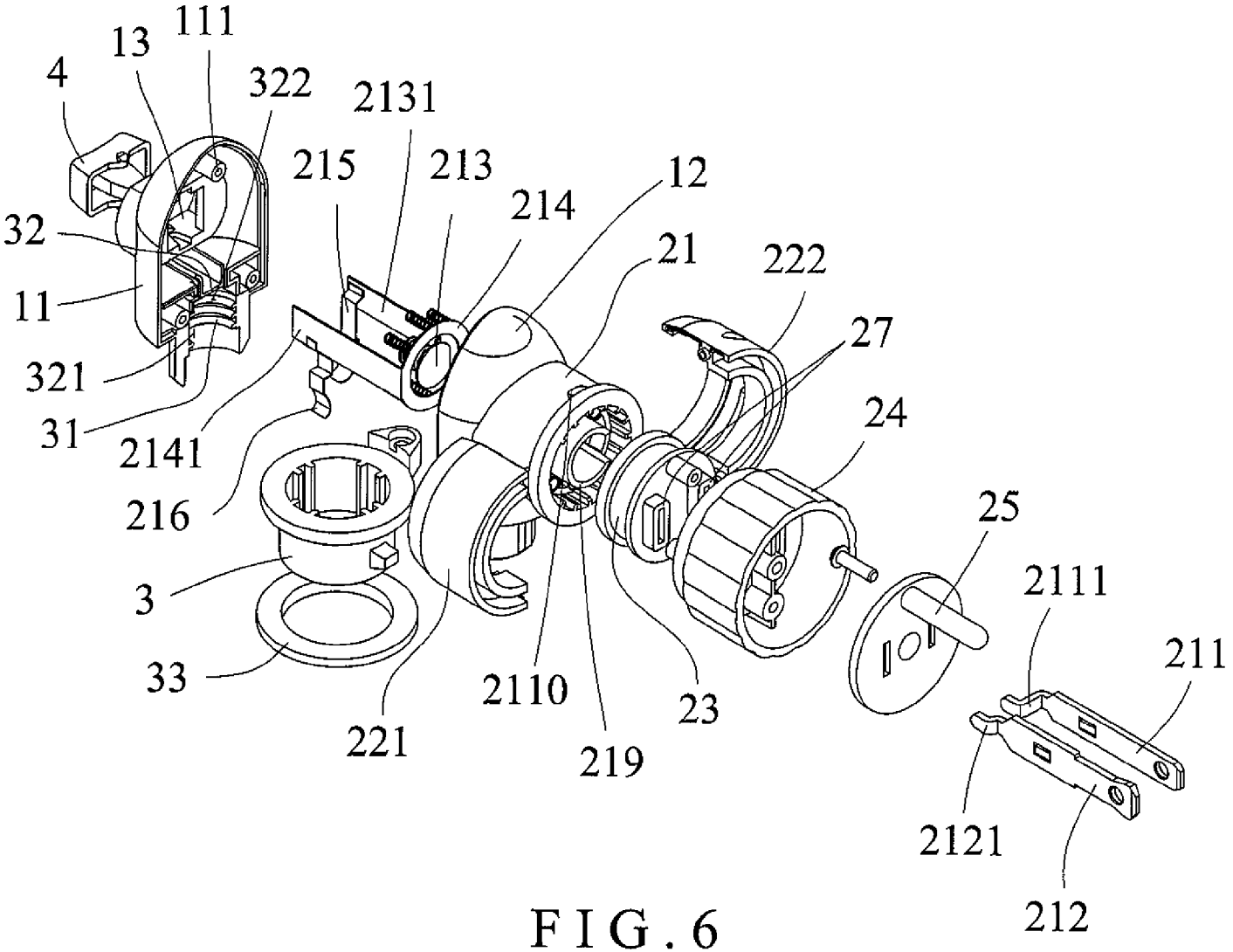
FIG. 6 is an exploded perspective view of the swivel-type night light as shown in FIG. 2.
Figure 7:
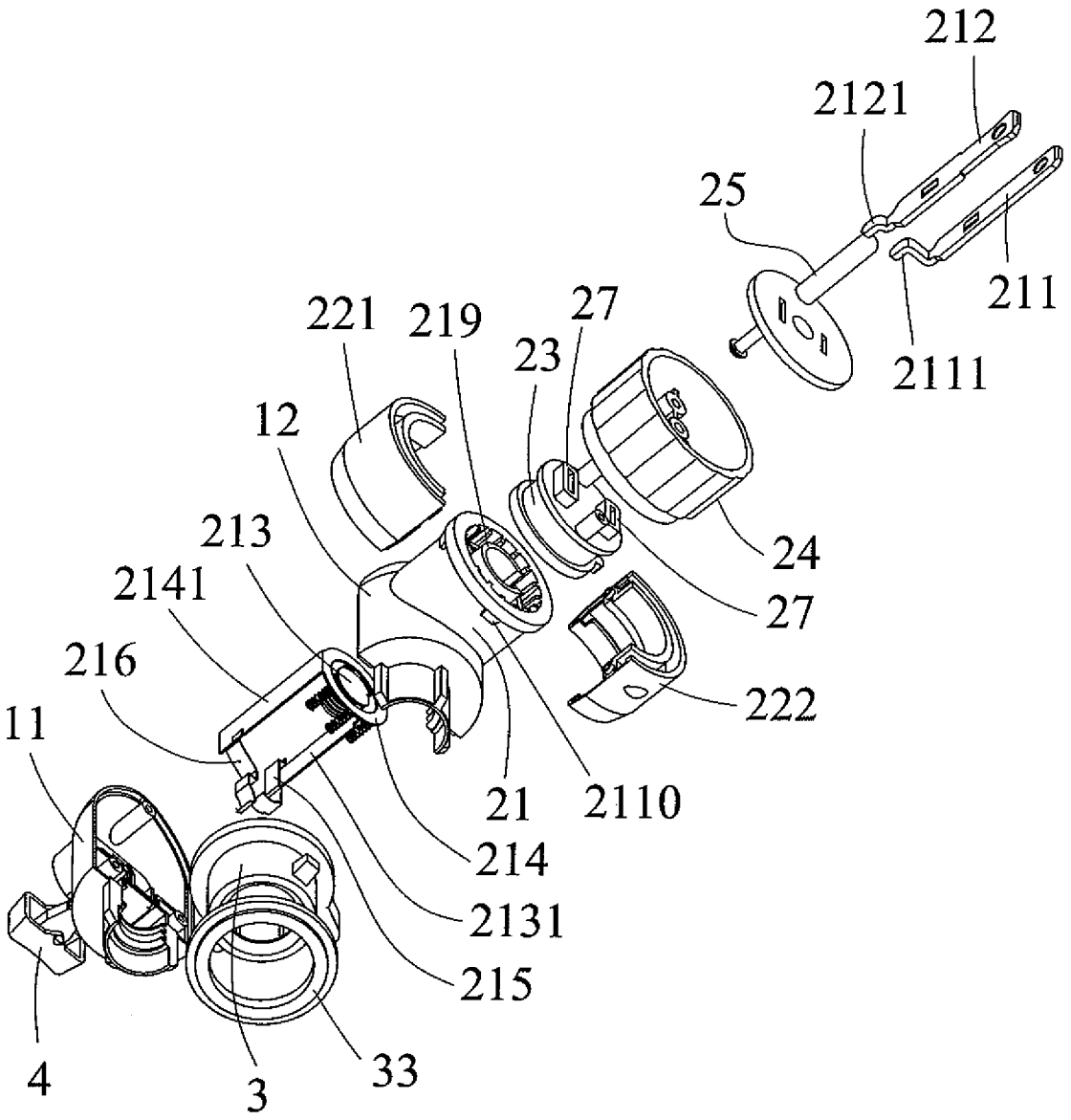
FIG. 7 is another exploded perspective view of the swivel-type night light as shown in FIG. 2.
Figure 8:
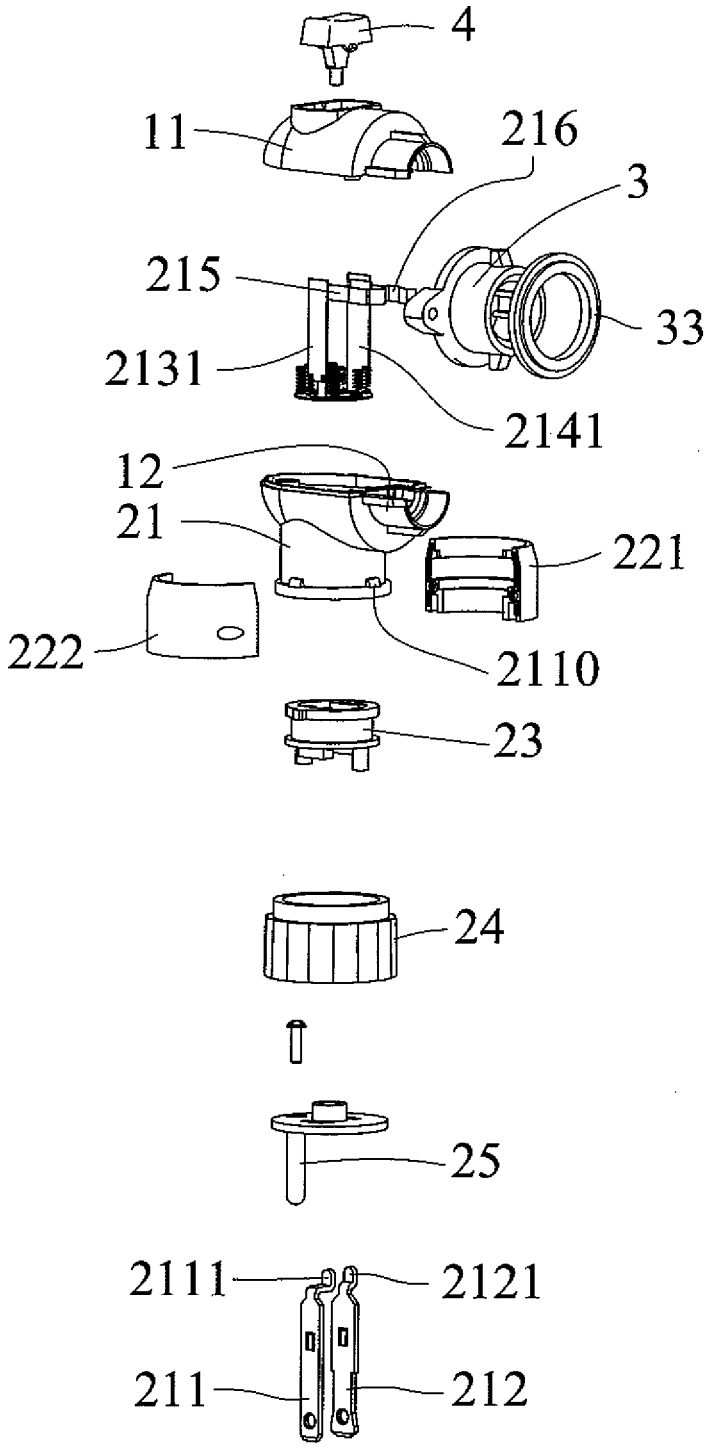
FIG. 8 is another exploded perspective view of the swivel-type night light as shown in FIG. 2.
Figure 9:
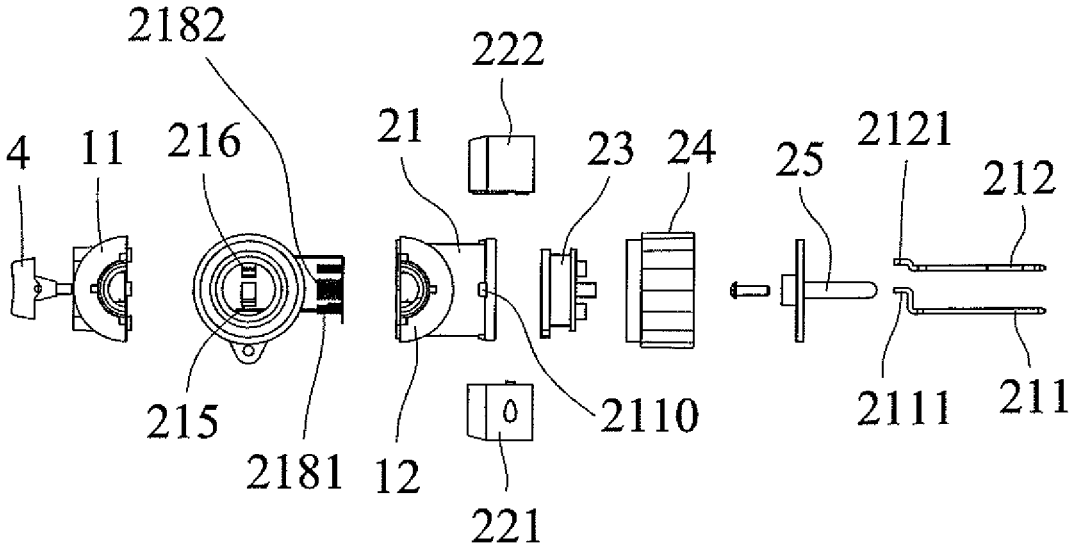
FIG. 9 is another exploded perspective view of the swivel-type night light as shown in FIG. 2.
Figure 10:
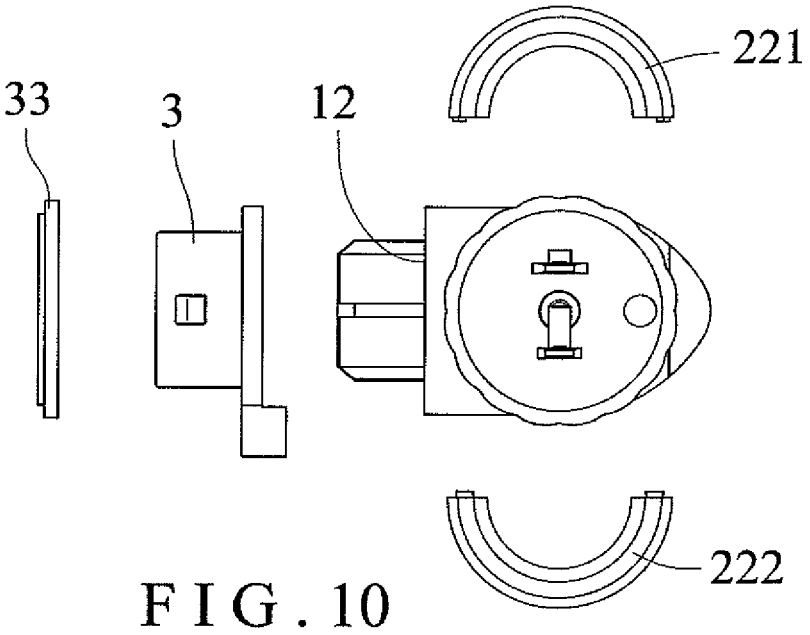
FIG. 10 is another exploded perspective view of the swivel-type night light as shown in FIG. 2.
Figure 11:
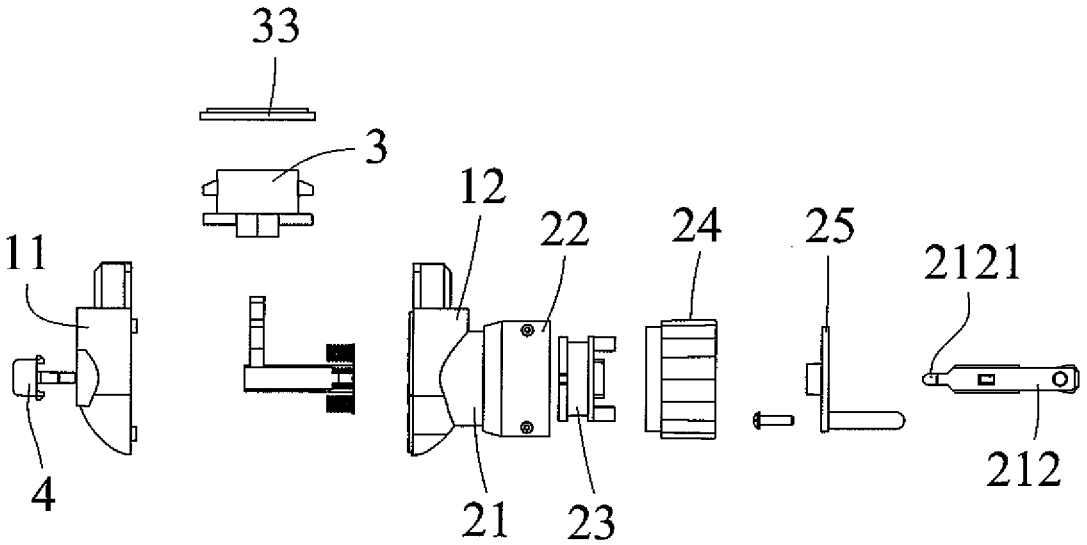
FIG. 11 is another exploded perspective view of the swivel-type night light as shown in FIG. 2.
Figure 12:
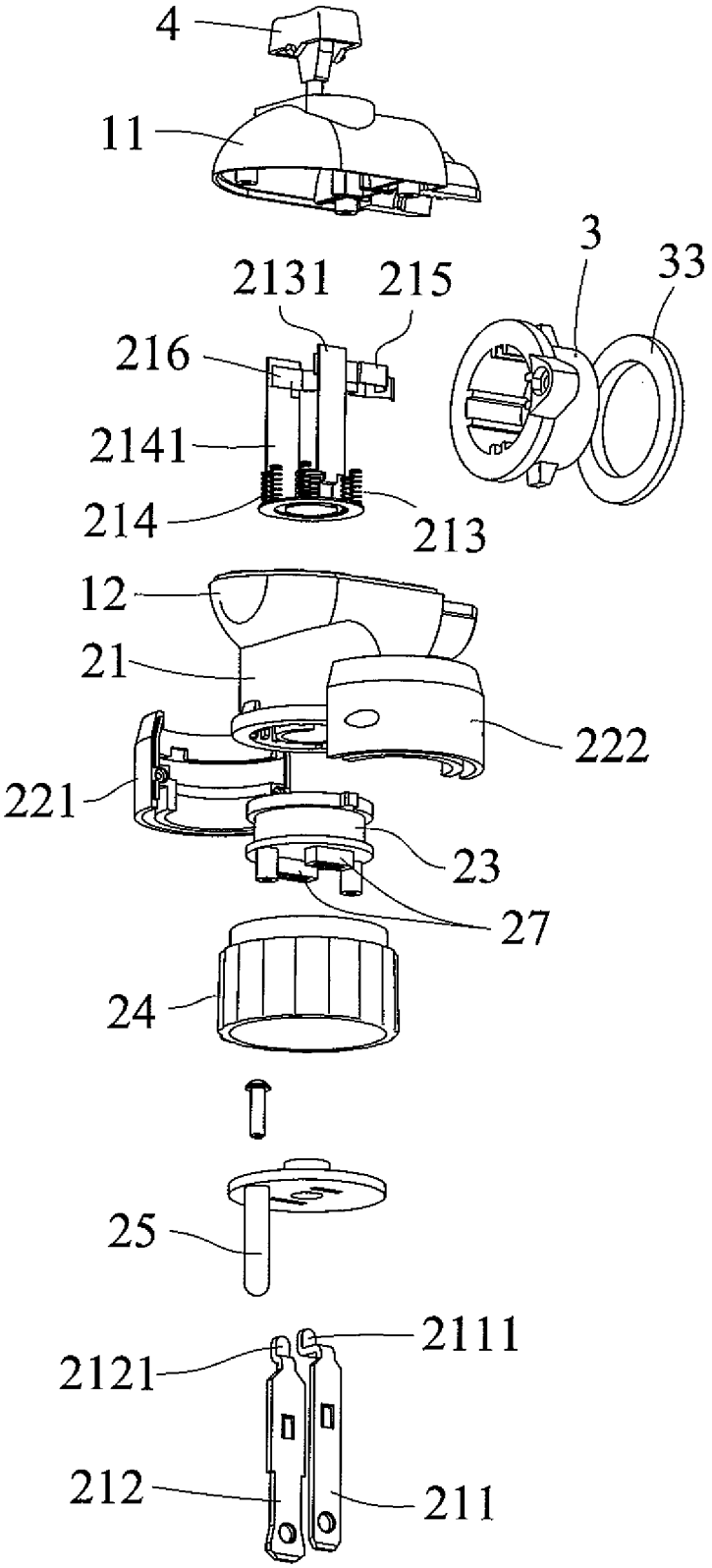
FIG. 12 is another exploded perspective view of the swivel-type night light as shown in FIG. 2.
Figure 13:
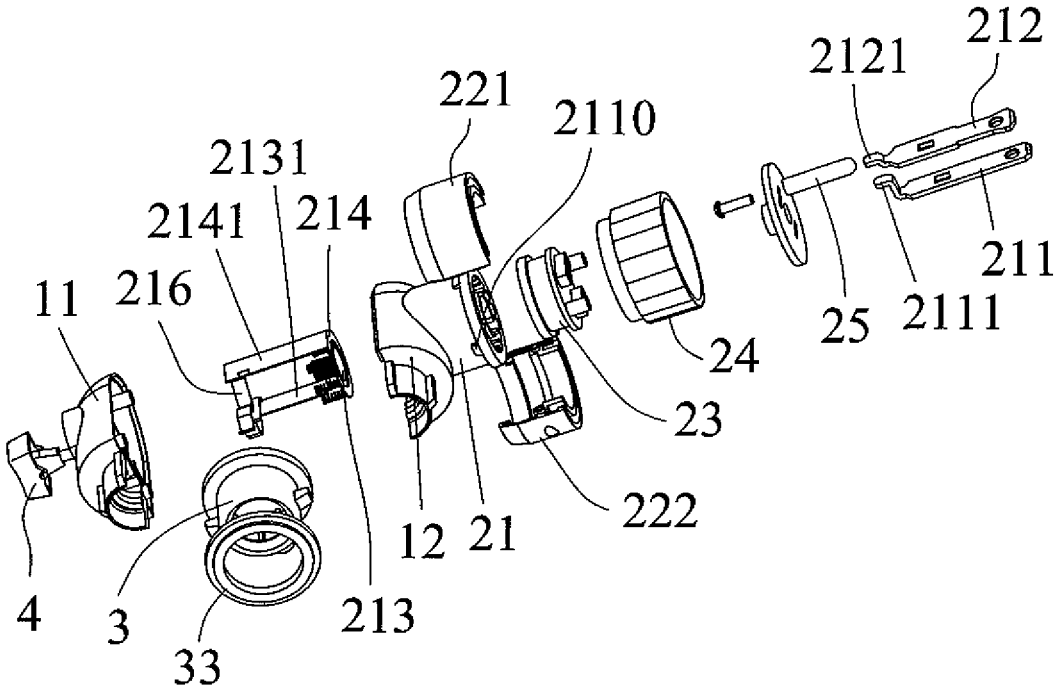
FIG. 13 is another exploded perspective view of the swivel-type night light as shown in FIG. 2.

Referring to FIGS. 1-13, a swivel-type night light in accordance with the preferred embodiment of the present invention comprises a housing 1, a socket mechanism 2 mounted on the housing 1, a bulb mechanism 3 mounted on the housing 1, and a switch 4 mounted on the housing 1.

The housing 1 includes a first casing 11 and a second casing 12 combined together. The first casing 11 has a left side provided with a slideway 13. The second casing 12 has a right side provided with a fixed seat 21. An intermediate seat 23 is mounted on a right side of the fixed seat 21. A connecting seat 22 is mounted around the fixed seat 21 and the intermediate seat 23, and the fixed seat 21 is rotatable relative to the connecting seat 22 and the intermediate seat 23 through 360 degrees. The connecting seat 22 is juxtaposed to the housing 1 and includes a first shell 221 and a second shell 222 combined together. A bottom ring 24 is mounted on a right side of the intermediate seat 23 and juxtaposed to the connecting seat 22. A thin plate 25 is mounted on a right side of the bottom ring 24. The fixed seat 21 has a left end face provided with a projection 26. A first spring 217 is mounted on the projection 26 of the fixed seat 21 and is biased between the switch 4 and the fixed seat 21.

The intermediate seat 23 has a right end face provided with two insertion slots 27 for securing a positive blade 211 and a negative blade 212 to construct a plug of an electric source. Each of the positive blade 211 and the negative blade 212 has a left end respectively provided with a first tongue 2111 and a second tongue 2121 protruding outward from a left end face of the intermediate seat 23. The first tongue 2111 of the positive blade 211 contacts with a positive conducting plate 213 so that the positive blade 211 is electrically connected with the positive conducting plate 213. The second tongue 2121 of the negative blade 212 contacts with a negative conducting plate 214 so that the negative blade 212 is electrically connected with the negative conducting plate 214.

The negative conducting plate 214 surrounds the positive conducting plate 213. The positive conducting plate 213 and the negative conducting plate 214 are secured in the fixed seat 21 and have the same center. The positive conducting plate 213 and the negative conducting plate 214 respectively are rotatable relative to and keep in successive contact with the first tongue 2111 of the positive blade 211 and the second tongue 2121 of the negative blade 212. The positive conducting plate 213 is provided with a positive transmission strip 2131 extending through a first guide slot 2112 of the fixed seat 21. The negative conducting plate 214 is provided with a negative transmission strip 2141 extending through a second guide slot 2113 of the fixed seat 21. The positive transmission strip 2131 is provided with a positive contact piece 215 protruding outward from the first guide slot 2112 of the fixed seat 21. The negative transmission strip 2141 is provided with a negative contact piece 216 protruding outward from the second guide slot 2113 of the fixed seat 21.

The negative contact piece 216 extends to a conducting member 32 and is electrically connected with a negative electrode 321. The positive contact piece 215 extends to the conducting member 32 and is electrically connected with a positive electrode 322 by regulation of the switch 4. A bulb 5 is mounted on the bulb mechanism 3 and is electrically connected with the conducting member 32 by an internal thread 31. The conducting member 32, the negative electrode 321, the positive electrode 322 and the internal thread 31 are mounted in the housing 1. The conducting member 32 is located above the internal thread 31.

The socket mechanism 2 is mounted on the right side of the second casing 12. The bulb mechanism 3 is mounted on a bottom of the housing 1 by a retaining ring 33. The switch 4 is slidably mounted in the slideway 13 of the housing 1.

In the preferred embodiment of the present invention, the projection 26 of the fixed seat 21 has a circular shape. The first spring 217 has an elongate thin shape. The first tongue 2111 of the positive blade 211 has an inverted L-shaped profile and has a projecting portion with a length of about 3.5 cm. The second tongue 2121 of the negative blade 212 has an inverted L-shaped profile and has a projecting portion with a length of about 3.5 cm. The distance between the first tongue 2111 and the second tongue 2121 is smaller than that between the positive blade 211 and the negative blade 212. The first tongue 2111 of the positive blade 211 has a downward bending length of about 5.0 cm. The second tongue 2121 of the negative blade 212 has a downward bending length of about 3.5 cm. The positive conducting plate 213 has a circular shape. The negative conducting plate 214 has an annular shape. The positive transmission strip 2131 having a rectangular shape is perpendicular to the positive conducting plate 213 and is distributed in a radial direction. The negative transmission strip 2141 having a rectangular shape is perpendicular to the negative conducting plate 214 and is distributed in a radial direction. The positive contact piece 215 is S-shaped and extends downward. The negative contact piece 216 extends downward and has a recessed middle portion.

In the preferred embodiment of the present invention, the fixed seat 21 has a periphery provided with a plurality of protrusions 2110 secured in a plurality of locking grooves (see FIG. 12) of the connecting seat 22 so that the fixed seat 21 is locked onto the connecting seat 22. Preferably, the fixed seat 21 has four protrusions 2110 each having a rectangular shape. When the fixed seat 21 is pushed toward the connecting seat 22, the protrusions 2110 of the fixed seat 21 are detached from the connecting seat 22 so that the fixed seat 21 is unlocked from and rotatable relative to the connecting seat 22.

In the preferred embodiment of the present invention, a plastic ring 219 is arranged between the positive conducting plate 213 and the negative conducting plate 214 to prevent the positive conducting plate 213 and the negative conducting plate 214 from contacting with each other. Preferably, the plastic ring 219 has a rectangular breach. An annular groove 28 is defined between the positive conducting plate 213 and the negative conducting plate 214, and the plastic ring 219 is inserted into the annular groove 28.

In the preferred embodiment of the present invention, the thin plate 25 has a plastic head that has a length greater than that of each of the positive blade 211 and the negative blade 212 and is inserted into a socket satisfying the American standard.

In the preferred embodiment of the present invention, the positive conducting plate 213 is provided with a second spring 2182 biased between the positive conducting plate 213 and the fixed seat 21, and the negative conducting plate 214 has a periphery provided with a plurality of third springs 2181 each biased between the negative conducting plate 214 and the fixed seat 21. Preferably, the negative conducting plate 214 is provided with six third springs 2181. The second spring 2182 has a thick short shape. Each of the third springs 2181 has a thin short shape.

In the preferred embodiment of the present invention, the first casing 11 is provided with a plurality of male threaded posts 111, and the second casing 12 is provided with a plurality of female threaded posts 121 connected with the male threaded posts 111 by a plurality of screws. Preferably, the first casing 11 is provided with three male threaded posts 111, and the second casing 12 is provided with three female threaded posts 121.

In operation, when the housing 1 is pushed toward the connecting seat 22, the fixed seat 21 is drive by the housing 1 to move toward the connecting seat 22, and the protrusions 2110 of the fixed seat 21 are moved to detach from the connecting seat 22 so that the fixed seat 21 is unlocked from and rotatable relative to the connecting seat 22. Thus, the housing 1 and the fixed seat 21 can be rotated relative to the connecting seat 22 to rotate the bulb mechanism 3 so as to adjust the direction of the bulb 5. When the fixed seat 21 is rotated relative to the connecting seat 22, the positive conducting plate 213 and the negative conducting plate 214 are respectively rotated relative to the positive blade 211 and the negative blade 212. When the positive conducting plate 213 and the negative conducting plate 214 are rotated, the positive conducting plate 213 and the negative conducting plate 214 respectively keep in successive contact with the first tongue 2111 of the positive blade 211 and the second tongue 2121 of the negative blade 212 so as to maintain the electrical connection. After rotation of the bulb mechanism 3 is finished, the fixed seat 21 is pushed by the restoring force of the second spring 2182 and the third springs 2181 to move outward relative to the connecting seat 22, and the protrusions 2110 of the fixed seat 21 are locked into the connecting seat 22, so that the fixed seat 21 is locked onto the connecting seat 22 again.

Accordingly, the plastic ring 219 is arranged between the positive conducting plate 213 and the negative conducting plate 214 to prevent the positive conducting plate 213 and the negative conducting plate 214 from contacting with each other, thereby preventing from incurring an electric short circuit. In addition, the fixed seat 21 is rotated relative to the connecting seat 22 stably so that the bulb mechanism 3 is rotated easily and conveniently.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A swivel night light comprising:

a housing;

a socket mechanism mounted on the housing;

a bulb mechanism mounted on the housing; and a switch mounted on the housing;

wherein:

the housing includes a first casing and a second casing combined together;

the first casing has a left side provided with a slideway;

the second casing has a right side provided with a fixed seat;

an intermediate seat is mounted on a right side of the fixed seat;

a connecting seat is mounted around the fixed seat and the intermediate seat, and the fixed seat is rotatable relative to the connecting seat through 360 degrees;

the fixed seat has a periphery provided with a plurality of protrusions secured in a plurality of locking grooves of the connecting seat, with the fixed seat being locked onto the connecting seat;

when the housing is moved toward the connecting seat, the fixed seat is driven by the housing and moved axially toward the connecting seat, and the protrusions of the fixed seat are moved axially and detached from the locking grooves of the connecting seat, with the fixed seat being unlocked from and rotatable relative to the connecting seat;

the connecting seat includes a first shell and a second shell combined together;

a bottom ring is mounted on a right side of the intermediate seat;

a thin plate is mounted on a right side of the bottom ring;

the fixed seat has a left end face provided with a projection;

a first spring is mounted on the projection of the fixed seat and is biased between the switch and the fixed seat;

the intermediate seat has a right end face provided with two insertion slots for securing a positive blade and a negative blade;

each of the positive blade and the negative blade has a left end respectively provided with a first tongue and a second tongue protruding outward from a left end face of the intermediate seat;

the first tongue of the positive blade contacts with a positive conducting plate so that the positive blade is electrically connected with the positive conducting plate;

the second tongue of the negative blade contacts with a negative conducting plate so that the negative blade is electrically connected with the negative conducting plate;

the negative conducting plate surrounds the positive conducting plate;

the positive conducting plate is provided with a positive transmission strip extending through a first guide slot of the fixed seat;

the negative conducting plate is provided with a negative transmission strip extending through a second guide slot of the fixed seat;

the positive transmission strip is provided with a positive contact piece protruding outward from the first guide slot of the fixed seat;

the negative transmission strip is provided with a negative contact piece protruding outward from the second guide slot of the fixed seat;

the negative contact piece extends to a conducting member and is electrically connected with a negative electrode;

the positive contact piece extends to the conducting member and is electrically connected with a positive electrode by regulation of the switch;

a bulb is mounted on the bulb mechanism and is electrically connected with the conducting member by an internal thread; and the switch is slidably mounted in the slideway of the housing.

2. The swivel night light of claim 1, wherein a plastic ring is arranged between the positive conducting plate and the negative conducting plate to prevent the positive conducting plate and the negative conducting plate from contacting with each other, an annular groove is defined between the positive conducting plate and the negative conducting plate, and the plastic ring is inserted into the annular groove.

3. The swivel night light of claim 1, wherein the thin plate has a plastic head that has a length greater than that of each of the positive blade and the negative blade and is inserted into a socket.

4. The swivel night light of claim 1, wherein the positive conducting plate is provided with a second spring biased between the positive conducting plate and the fixed seat, and the negative conducting plate has a periphery provided with a plurality of third springs each biased between the negative conducting plate and the fixed seat.

5. The swivel night light of claim 1, wherein the first casing is provided with a plurality of male threaded posts, and the second casing is provided with a plurality of female threaded posts connected with the male threaded posts by a plurality of screws.

* * * * *